US006291017B1

(12) United States Patent
Rantanen

(10) Patent No.: US 6,291,017 B1
(45) Date of Patent: Sep. 18, 2001

(54) METHOD FOR COATING A MOVING WEB WITH AT LEAST TWO COAT LAYERS

(75) Inventor: Rauno Verner Rantanen, Muurame (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 08/811,902

(22) Filed: Mar. 5, 1997

(30) Foreign Application Priority Data

Mar. 6, 1996 (FI) ..... 961026

(51) Int. Cl.[7] ..... B05D 3/12

(52) U.S. Cl. ..... 427/356; 427/407.1; 427/411; 427/428

(58) Field of Search ..... 427/428, 356, 427/407.1, 411

(56) References Cited

U.S. PATENT DOCUMENTS

| | | | |
|---|---|---|---|
| 2,772,184 | | 11/1956 | Wolfe et al. . |
| 2,937,955 | | 5/1960 | Loomer . |
| 2,961,342 | * | 11/1960 | Snyder . |
| 3,222,209 | * | 12/1965 | Brundige et al. . |
| 3,952,119 | * | 4/1976 | Buhler ..... 427/428 X |
| 4,277,524 | | 7/1981 | Nakajima et al. . |
| 4,358,499 | * | 11/1982 | Hill . |
| 4,980,207 | | 12/1990 | Sollinger . |
| 5,101,760 | | 4/1992 | Sollinger . |
| 5,224,996 | | 7/1993 | Ghys et al. . |
| 5,340,611 | | 8/1994 | Kustermann et al. . |
| 5,690,999 | * | 11/1997 | Rantanen . |
| 5,811,183 | * | 9/1998 | Shaw et al. . |

FOREIGN PATENT DOCUMENTS

| | | |
|---|---|---|
| 0417368 | 3/1991 | (EP) . |
| 0 411 196 B1 | 11/1993 | (EP) . |
| 0 596 365 A1 | 5/1994 | (EP) . |
| 0 609 484 B1 | 2/1997 | (EP) . |
| 94274 | 1/1990 | (FI) . |
| 91178 | 2/1991 | (FI) . |
| 94883 | 5/1994 | (FI) . |
| 940510 | 8/1994 | (FI) . |
| 94274 | 4/1995 | (FI) . |
| 96338 | 10/1995 | (FI) . |
| 96338 | 2/1996 | (FI) . |
| 0620280 | 7/1978 | (SU) . |
| 92/00419 | 1/1992 | (WO) . |
| PCT/FI95/00221 | 10/1995 | (WO) . |

* cited by examiner

*Primary Examiner*—Bernard Pianalto
(74) *Attorney, Agent, or Firm*—Cohen, Pontani, Lieberman & Pavane

(57) ABSTRACT

A method for coating a paper or paperboard web with at least two coat layers. The present invention achieves two-layer coating and is capable of providing a smooth coat with high opacifying power. A first coat layer is initially applied to the web. The surface of this first coat layer is smoothed by means of a smoothing element. After smoothing, this first coat layer is partially or entirely dried, and a second coat layer is applied onto the first coat layer using a transfer coater.

22 Claims, 1 Drawing Sheet

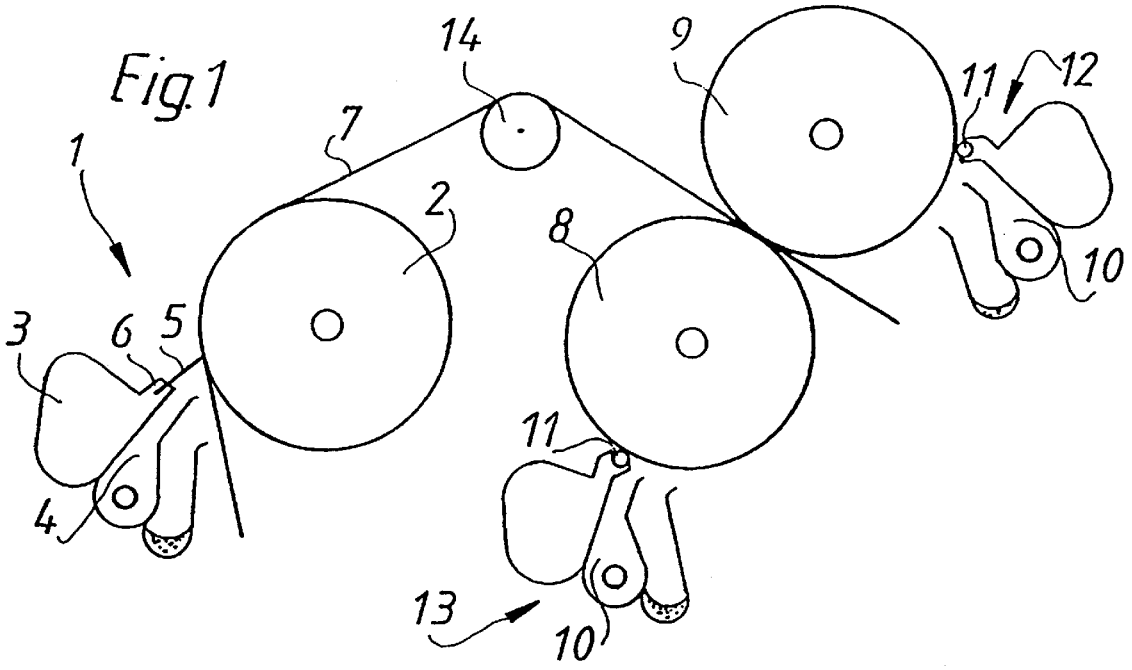
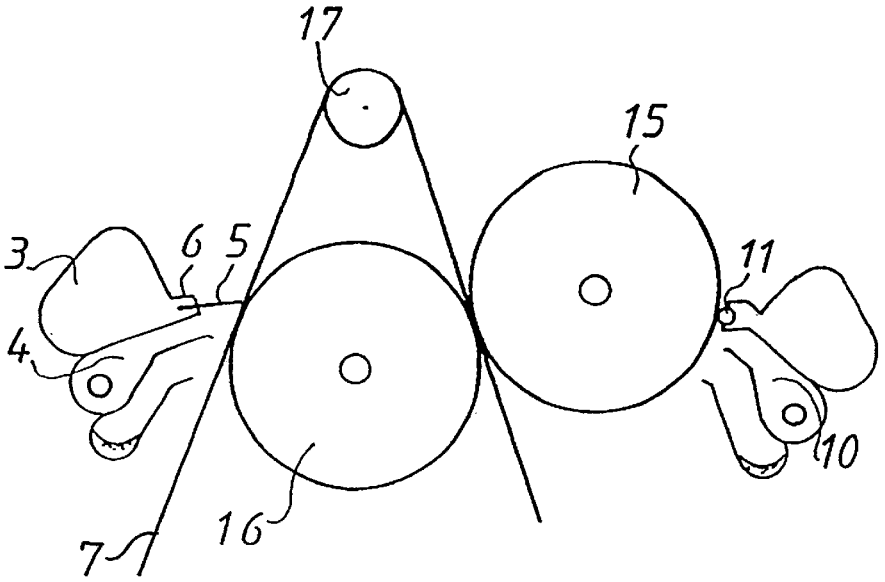
Fig.2

METHOD FOR COATING A MOVING WEB WITH AT LEAST TWO COAT LAYERS

FIELD OF THE INVENTION

The present invention relates to a method and apparatus for coating a moving paperboard or paper web with at least two coat layers.

BACKGROUND OF THE INVENTION

To improve the printability of paper and cardboard, one or more coat layers can be applied on these webs. The greater the number of coat layers, the better the quality of the coated sheet with the additional possibility of using coating furnishes of different compositions. However, such use of two different coat layers causes a significant increase in production costs, because the coat application is conventionally made in several steps and the applied coat is dried prior to the application of the next layer.

The coat can be applied either directly to the web surface using, e.g., a blade or rod coater, or alternatively, a transfer roll coater in which a coat film premetered on a transfer roll is applied in a roll nip to the web surface. Blade and rod coaters are characterized in that the coater seals the surface texture voids of the base web and smooths the surface, whereby the thickness of the coat layer varies according to the volume of the surface texture voids in the base web. The final result is a smooth coat having an uneven brightness distribution combined with difficult control of smooth absorption of the coat.

Transfer roll coating provides a coat with an essentially improved constant thickness, whereby easy control of coat absorption is attained, though sufficient smoothness properties are a problem, particularly with thicker grades of paper and paperboard. The transfer coat also achieves a relatively even coverage whereby the coated web brightness of a base web with, e.g., a low initial brightness, can be improved essentially using this coating method. Furthermore, since the transfer roll coating method dispenses with a doctor blade running in contact with the base web to be coated, the method offers excellent runnability with respect to interruptions in the coating process.

Two different approaches have been applied to utilize the advantageous properties of both coating methods.

Transfer roll coating is used widely in precoat application. This method can improve the coating result through the increased total coat weight in which a single doctored coat layer can assume sufficient coat smoothness. Conventionally, the precoat is dried prior to the subsequent final coat application, which typically is applied using a doctor blade coater. Also known in the art from U.S. Pat. No. 2,937,955 is doctor blade application directly onto a semidry transfer precoat. A precondition to the use of this method is that the precoat has already settled or set so much that it can take the final coat application by means of the doctor blade coater. Setting of the coat can be speeded by, e.g., partial drying of the precoat in situations where the coat has not become sufficiently dewatered through absorption under pressure in the coating nip and due to moisture migration from the coat during the web travel over the free distance between the precoater and the final coater units.

The web travel delay and coat setting time occurring between the transfer precoater and the doctor blade final coater can be extended by, e.g., increasing the web travel distance between the coater units, thus achieving sufficient setting and dryness of the precoat through the extended moisture absorption time for the subsequent doctor blade coat application step. U.S. Pat. No. 5,340,611 discloses a method in which the amount of coat applied in the transfer roll coating step is kept so small that the doctor blade of the knife applicator device cannot scrape the precoat away. However, such a method fails to achieve the maximum precoat weight possible by means of a transfer roll coater, and the first precoat layer remains very thin. According to the method, the smoothing element of second applicator device can be a levelling rod instead of a doctor blade.

In pilot-scale test runs of this paperboard coating method, not even increasing the delay between the coating steps could make the precoat set at 10 g/m$^2$ coat weight sufficiently to avoid partial scraping-away of the already applied precoat in the subsequent doctor blade applicator. As the web speed is fixed by the speed at the coat transfer nip while the subsequent blade applicator causes a braking action on the web, a problem was also caused by the tendency of the web to produce a bag or slack in front of the smoothing blade of the applicator device resulting in web breaks. Hence, the method was not found practicable. The frequency of web breaks is further increased by the fact that the blade application step, which causes appreciably higher stress on the web than the preceding transfer roll coating step, is performed on a web of high moisture, whereby the web strength is obviously much lower than that of a dry web.

Another approach to the utilization of the special characteristics of transfer and blade application steps is disclosed in finnish patent application Ser. No. 941,803 of Valmet Corporation wherein the coater unit has a design permitting the use, according to the specifications of the final product and/or runnability criteria, of either a transfer or blade applicator as alternative methods yet employing the same coat dryer for both coating methods. Because this apparatus fails to utilize the benefits of two-layer coating, its principal benefit is to increase the flexibility of production, but not to improve the quality of the end product over comparable one-layer coating methods.

However, particularly thicker grades of paper and paperboard present a need for combining the benefits of both the transfer and the blade coating methods. Yet, due to lack of sufficient footprint and investment capital, intermediate drying of the precoat is not always possible. In such a case the only remaining alternative is the above-described type of wet-on-wet coating, in which the present methods fail to provide sufficiently heavy total coat thicknesses in which the high opacifying power of the transfer roll coating method and the good smoothness given by blade application could be utilized in an optimal manner.

SUMMARY OF THE INVENTION

It is an object of the present invention to achieve a two-layer coating method capable of applying a smooth coat of high opacifying power.

This goal is accomplished by initially applying a first coat layer onto the surface of the web to be coated which is levelled by means of a smoothing element and subsequently applying a second coat layer by means of a transfer roll applicator onto the web carrying the first, partially or entirely dried, moist coat layer.

The present invention offers significant benefits.

The present invention makes it possible to apply a very heavy coat on the web even without intermediate drying, whereby test runs have proved that it is possible to apply heavy total coat weights as high as 20 g/m$^2$ by applying a 10 g/m$^2$ coat was applied in a blade coater after which another 10 g/m$^2$ coat was applied in a subsequent transfer roll applicator. The coat will be sufficiently smooth, sealing up properly the voids of the web surface texture, simultaneously giving good brightness. The blade coating step can be carried out using a low-cost coat furnish capable of smoothing the web surface texture, while the transfer roll application step is performed using a higher-cost, fine-dispersed coat capable of imparting good printability and coverage. Since the transfer roll coating step does not damage the first coat layer, the smooth precoat makes it possible for the transfer roll to give a smoother final surface than is conventional in the art. The blade of the first coater keeps the web entering the transfer roll coating step tensioned, thus maintaining the web between the coater units free of bags. The web runnability remains good as the transfer roll imposes only a minor load on the moist web.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views:

FIG. 1 is a schematic side view of a first embodiment of the present invention; and FIG. 2 is a schematic side view of a second embodiment of the present invention.

DETAILED DESCRIPTION OF THE PRESENTLY PREFERRED EMBODIMENTS

The present invention can be carried out using conventional coaters. Referring to FIG. 1, the embodiment shown therein has the blade coating step implemented as a short dwell time coater, while the transfer roll coater is an applicator suited for coating both sides of the web. The short dwell time coater 1 comprises a backing roll 2 and a short-dwell applicator having a blade holder beam 3 incorporating an application chamber 4, in which one of the chamber walls is formed by a doctor blade 5 mounted to the outgoing side of the web travel. The blade 5 is loaded by an adjustable loading assembly 6, which is also suitable for controlling the cross-machine profile of the applied coat. The coating mix is delivered into the applicator chamber 4, wherefrom it is applied onto the surface of the web 7. A portion of the coating mix flows in a direction opposite backward to the travel direction of the web 7 and is recirculated.

From the short-dwell coater 1, the web 7 is passed to the transfer roll coater where a second coat layer is applied to the web surface. Again referring to FIG. 1, the apparatus shown therein has two transfer rolls 8, 9 forming a nip through which the web 7 is passed. In the illustrated embodiment, the film of coating is metered onto the surfaces of the rolls 8, 9 by means of a rod applicator 12, 13 incorporating analogously with a short-dwell coater an application chamber 10 in which one of the chamber walls is formed by a levelling rod 11 adapted to the outgoing side of the web 7. The levelling rod 11 meters onto the surface of the roll 9 a coating film which is transferred to the surface of the web 7 in the nip between the rolls 8, 9. To the surface of the other roll 8 forming the nip, a rod applicator 12 may additionally meter coating mix, water, size or dispersion in order to prevent warping of the web or to subject the other side of the web to a treatment.

Between the blade and the transfer roll coating is a guide roll 14 for guiding the web 7 to the transfer roll coating step. This roll 14 may be movable, whereby the travel distance of the web 7 between the coating steps can be controlled by adjusting its position. Such an arrangement gives a limited possibility of affecting moisture absorption from the coat layer applied by means of the blade coating step, whereby the first coat layer will become dryer prior to the application of the second coat layer even without resorting to intermediate drying.

Referring to FIG. 2, another embodiment of the present invention is shown therein having a single roll pair 15, 16 serving for both the blade coating and transfer roll coating steps. In this arrangement, the web is first passed onto a roll acting as both the backing roll 16 of the blade coating step and the backing roll of the transfer roll 15. The blade coating is performed in a conventional manner against the backing roll 16 after which the web 7 is passed to a guide roll 17 over which the web is passed to the nip between the backing roll 16 and the transfer roll 15 in which nip the second coat layer is applied to the surface of the web 7. The design of this apparatus is extremely compact, permitting two-layer coating in a very small space.

In addition to those described above, the present invention may have alternative embodiments. The blade coating step may be replaced by a levelling rod performing the application of the first coat layer. Furthermore, the transfer roll coating step may be arranged to coat the web two-sidedly, whereby one side of the web will be coated by a single coat layer and the other side by two layers. Two-layer coating can be applied alternatively to either the bottom side or the upper side of the web depending on the coater layout. Intermediate drying can be arranged between the blade and the transfer roll coating steps, whereby heavier coat weights may be applied and the smooth precoat applied by means of the doctor blade or rod can be better utilized. The blade coating step may be carried out using coaters of the short dwell time type described above, or alternatively, using transfer roll, spray nozzle or similar application method followed by levelling with a rod or blade.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the present invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method of coating a paper or paperboard web with two coat layers comprising:

applying a first coat onto an entirety of a first surface of a web by means of a first coater, the first coat being sufficient to smooth the first surface of the web;

leveling the first coat applied to the first surface of the web by means of a smoothing means;

applying an even film of coating onto a roll of a film transfer roll coater; and after the first coat has been levelled, applying a second coat onto an entirety of the first coat by transferring the even film of coating applied to the roll of the film transfer roll coater to the web so that no further leveling of the coating applied to the first surface of the web is required to obtain a smooth coating thereon.

2. The method of claim 1, wherein a third coat layer is applied to a second surface of the web, the second surface being opposite the first surface of the web.

3. The method of claim 2, wherein the third coat layer is applied to the web after the first coat is applied to the web.

4. The method of claim 2, wherein the third coat layer is applied to the web at the same time that the second coat is applied to the web.

5. The method of claim 2, wherein the first coat is leveled by a doctor blade.

6. The method of claim 2, wherein the first coat is leveled by a levelling rod.

7. The method of claim 1, wherein the first coat is leveled by a doctor blade.

8. The method of claim 1, wherein the first coat is leveled by a levelling rod.

9. The method of claim 1, wherein the first coat has a weight of approximately 10 $g/m^2$.

10. The method of claim 9, wherein the second coat has a weight of approximately 10 $g/m^2$.

11. The method of claim 1, wherein the second coat has a weight of approximately 10 $g/m^2$.

12. The method of claim 1, wherein the coated web has a final coating after the second coat is applied having a coat weight of approximately 20 $g/m^2$.

13. The method of claim 1, further comprising at least partially drying the first coat with a dryer after the first is applied and before the second coat is applied.

14. The method of claim 1, wherein the second coat is applied to the first coat before the first coat has completely dried.

15. The method of claim 14, wherein the first coat is leveled by a levelling rod.

16. The method of claim 14, wherein the web travels a distance between the first coater and the film transfer roll coater, the distance being selected so that the first coat at least partially dries before the second coat is applied thereon.

17. The method of claim 14, wherein the first coat is leveled by a doctor blade.

18. The method of claim 1, wherein the web travels a distance between the first coater and the film transfer roll coater, the distance being selected so that the first coat at least partially dries before the second coat is applied thereon.

19. The method of claim 18, wherein the second coat is applied to the first coat after the first coat has completely dried.

20. The method of claim 1, wherein the second coat is applied to the first coat after the first coat has completely dried.

21. The method of claim 20, wherein the first coat is leveled by a doctor blade.

22. The method of claim 20, wherein the first coat is leveled by a levelling rod.

* * * * *